US006352443B1

(12) United States Patent
Takahashi

(10) Patent No.: US 6,352,443 B1
(45) Date of Patent: Mar. 5, 2002

(54) LAMP SOCKET

(75) Inventor: Tetsuya Takahashi, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/709,440

(22) Filed: Nov. 13, 2000

(30) Foreign Application Priority Data

Nov. 17, 1999 (JP) ..... 11-327354

(51) Int. Cl.[7] ..... H01R 4/50
(52) U.S. Cl. ..... 439/336; 439/616
(58) Field of Search ..... 439/336, 611, 439/613, 616, 699.2, 595, 573; 362/487, 263, 546

(56) References Cited

U.S. PATENT DOCUMENTS 5,108,296 A * 4/1992 Takano et al. ..... 439/572
5,634,826 A * 6/1997 Jean et al. ..... 439/595
5,823,806 A * 10/1998 Nagase et al. ..... 439/336
5,842,882 A * 12/1998 Sato et al. ..... 439/336
5,924,884 A * 7/1999 Sato et al. ..... 439/336
6,162,084 A * 12/2000 Chen et al. ..... 439/336

* cited by examiner

*Primary Examiner*—Hien Vu
(74) *Attorney, Agent, or Firm*—Kanesaka & Takeuchi

(57) ABSTRACT

A lamp socket comprises a socket body (1) having a cylindrical section (6) with a front edge **(6*a*). The cylindrical section has an insertion groove (19) extending from the front edge in the axial direction of the cylindrical section for receiving the engaging pin (63) of a lamp plug section (61) and an engaging hole (18) extending from the insertion groove in the circumferential direction of the cylindrical section for engagement with the engaging pin upon rotation of the lamp B. A slit (22) is provided in the cylindrical section in parallel to the engaging hole such that the engaging hole is flanked by the slit and the front edge of the cylindrical section, forming a flexible portion (23)** between the slit and the engaging hole.

2 Claims, 6 Drawing Sheets

LAMP SOCKET

BACKGROUND OF THE INVENTION

1. Field of the Invention

The present invention relates to lamp sockets for automobile headlights.

2. Description of the Related Art

Recently developed lamps, such as automobile headlights, are as bright as daylight. Such a lamp has a lamp-side plugging section which is plugged into the socket-side plugging section provided in the socket body of a socket. The socket-side plugging section has a pair of terminals for contact with the lamp terminal and the contact portion of the lamp-side plugging section, respectively. The socket body has an engaging portion for engagement with an engaging pin provided at the lamp-side plugging section when the lamp- and socket-side plugging sections are coupled.

The lamp terminal and the contact portion are brought into contact with the terminals of the socket by plugging the lamp-side plugging section into the socket-side plugging section such that the engaging pin of the lamp-side plugging section engages the engaging portion of the socket.

However, the engaging pin has a difficulty in sliding on the engaging portion, making it difficult to attach or detach the lamp from the socket. Where the thickness of the engaging pin is reduced with respect to the engaging portion to make the attachment or detachment easy, it is frequent that the engaging pin comes out of the engaging portion.

SUMMARY OF THE INVENTION

Accordingly, it is an object of the invention to provide a lamp socket allowing smooth movement of the engaging pin, making it easy to attach or detach a lamp body from the socket body.

According to the invention there is provided a lamp socket comprising a socket body having a cylindrical section with a plugging cavity into which a plugging section of a lamp is plugged; a first-type terminal provided at a central area of the plugging cavity for contact with a lamp terminal; a second-type terminal provided at a periphery of the plugging cavity for contact with a peripheral contact provided on the plugging section of the lamp; and a lamp retention section having an insertion groove extending from an edge of the cylindrical section in an axial direction of the cylindrical section for receiving an engaging pin provided on a side wall of a the plugging section and an engaging portion extending from the insertion groove in a circumferential direction of the cylindrical section for engagement with the engaging pin; and a slit provided in the cylindrical section in parallel to the engaging portion to form a flexible portion between them for facilitating movement of the engaging pin along the engaging portion.

When the engaging pin of the lamp is inserted into the engaging portion of the socket to plug the lamp into the socket so that the lamp terminal and contact section are brought into contact with the first and second terminals of the socket, the flexible portion is flexed by the engaging pin, reducing the friction between the engaging pin and the engaging portion and facilitating attachment of the lamp to the socket.

To remove the lamp from the socket, the flexible portion is flexed to reduce the friction between the engaging pin and the engaging portion, facilitating the removal operation.

The engaging portion may be an engaging hole having a notch at its end opposite to the end communicating with the insertion groove. The notch facilitates expansion in the plugging direction of the engaging hole by the engaging pin and insertion of the engaging pin into the engaging portion.

The engaging hole may have a pair of parallel walls, at least one of which has a projection thereon. When the engaging pin is put into the engaging hole followed by rotation of the lamp or the reverse operation is made, the engaging pin passes the projection, producing a click and enhancing the lamp attaching or detaching operation.

The cylindrical section may be provided with a flange portion at its outer edge and a thickening portion extending from the flange portion to thicken a bottom wall of the insertion groove. The flange and thickening portions keep the strength of the cylindrical section despite the presence of the insertion groove and the engaging hole. As a result, the cylindrical section of the lamp is able to withstand against a forcible attempt to plug the lamp to the socket in a wrong alignment.

The slit may be provided on a side of the engaging hole opposite to the flange to form the flexible portion between them. When the engaging pin is put into the engaging hole so that the lamp terminal and the contact section are brought into contact with the first and second terminals, the flexible portion is flexed to expand the engaging hole, reducing the friction between the engaging pin and the engaging hole and facilitating attachment of the lamp to the socket. Where the lamp is removed, the flexible portion similarly is flexed to facilitate the removal operation.

DESCRIPTION OF THE PREFERRED EMBODIMENTS

Embodiments of the invention will now be described with reference to the accompanying drawings.

Figure 1:
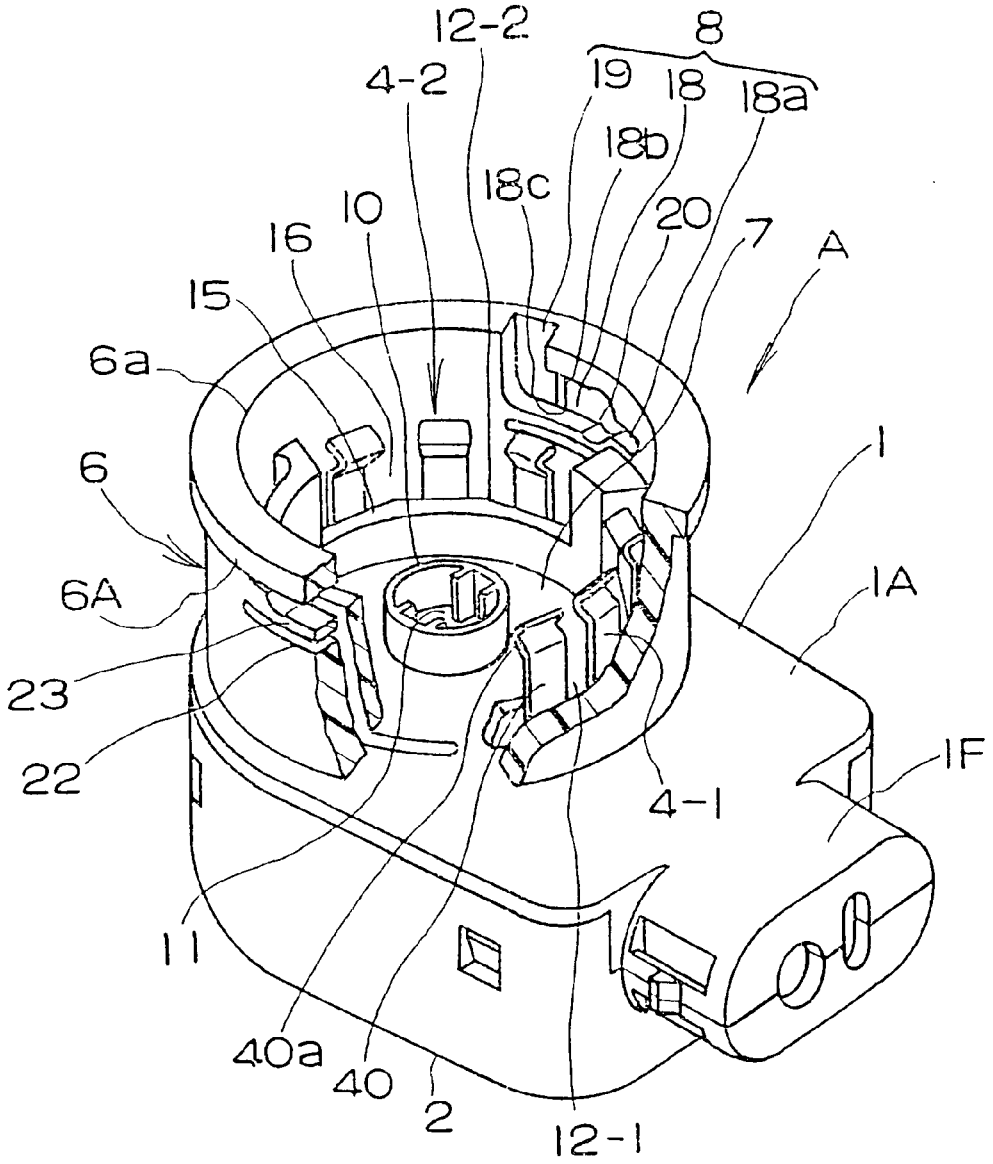
FIG. 1 is a partially cutout, perspective view of a lamp socket according to an embodiment of the invention.
Figure 2:
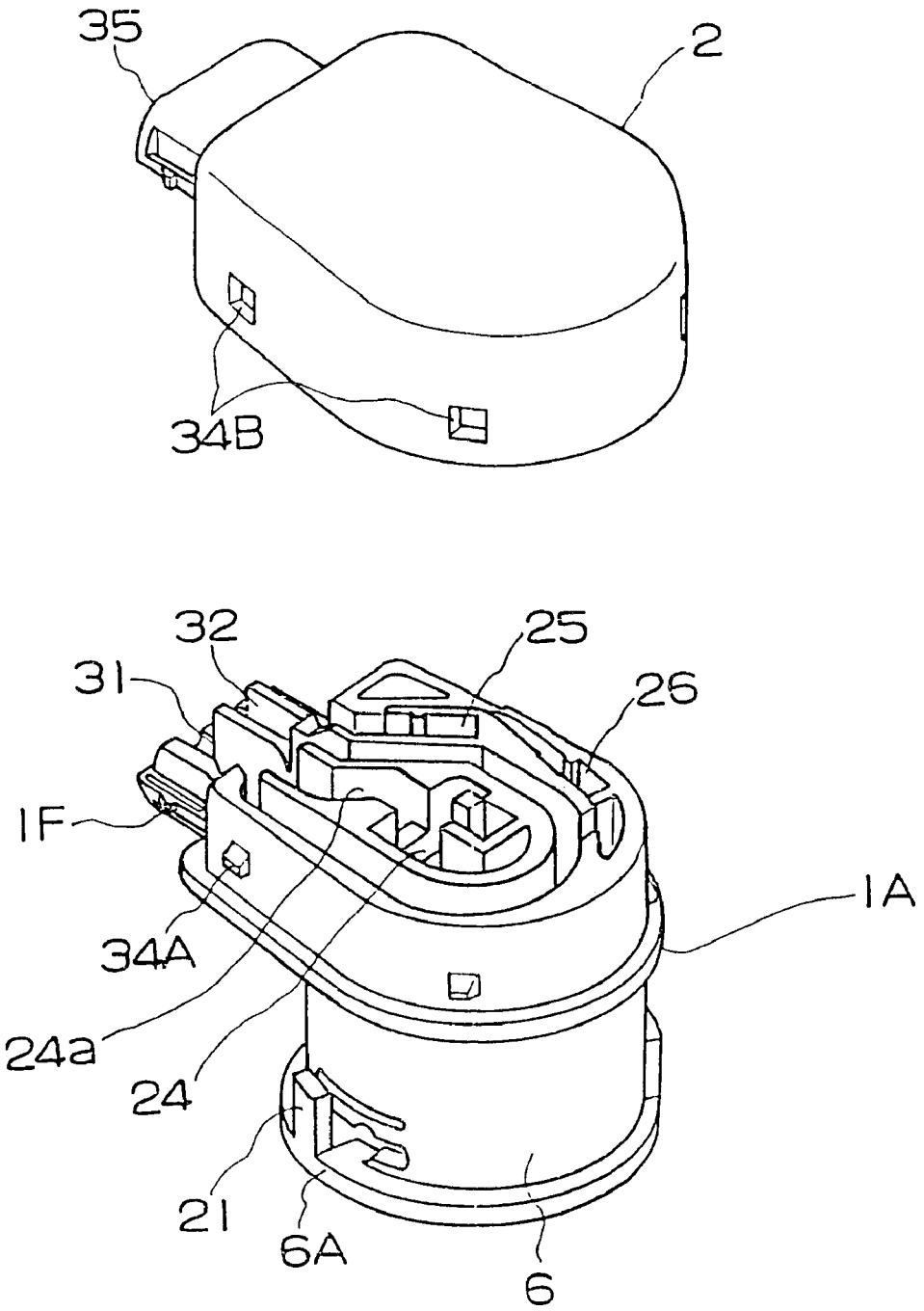
FIG. 2 is an exploded perspective view of the lamp socket as viewed from the bottom.
Figure 3A:
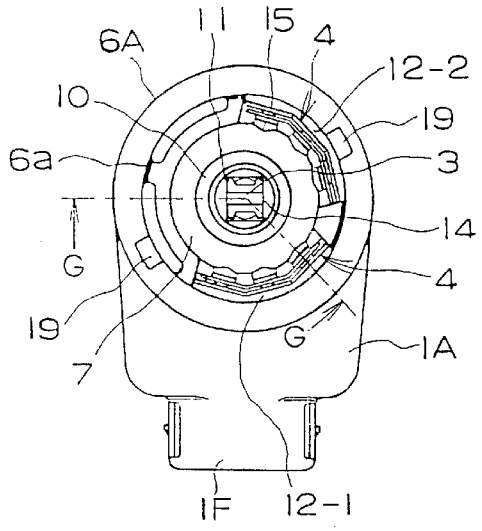
FIG. 3A is a top plan view of the lamp socket with the cover removed.
Figure 5A:
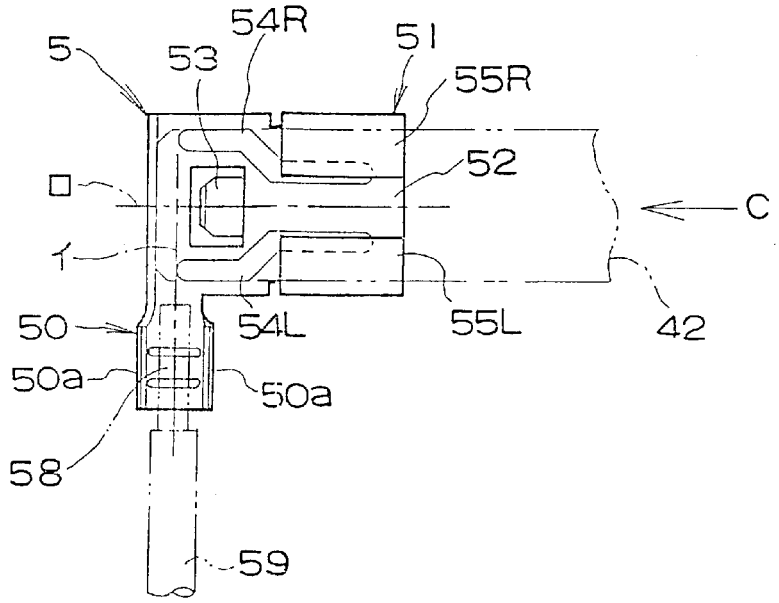
FIG. 5A is a top plan view of a crimp terminal.

FIG. 1 shows a lamp socket according to an embodiment of the invention and FIG. 2 shows the lamp socket with the cover removed. A lamp socket A comprises a socket body 1, a cover 2, a first-type terminal 3 provided at the center of the socket body 1 as shown in FIG. 3A, a plurality of second-type terminals 4-1, 4-2 provided at the periphery of the socket body 1, and a crimp terminal 5 as shown in FIG. 5A.

The socket body 1 has a base section 1A and a cylindrical section 6 extend forwardly from the base section 1A. An protruded portion 1F extends laterally from a side of the base section 1A. The front edge 6*a* of the cylindrical section 6 has a flange portion 6A so that it is thicker than the other part of the cylindrical section 6. The cylindrical section 6 has a socket-side plugging portion or socket cavity 7 and a pair of lamp retention portions 8 provided at diametrically opposed positions.

The socket cavity 7 is an annular space between a central tubular section 10 and the inner face 6B of the cylindrical section 6. A central terminal mount 11 is provided at the bottom of the tubular section 10 and first and second peripheral terminal mounts 12-1 and 12-2 provided at the periphery of the socket cavity 7. The central terminal mount 11 has a terminal leg aperture 14. The peripheral terminal mounts 12-1 and 12-2 are separated by a partition wall 15 with terminal exposure openings 16. A plurality of terminal leg apertures 17-1 and 17-2 are provided at the bottom of the peripheral terminal mounts 12-1 and 12-2.

Each lamp retention portion 8 has a lateral groove or engaging hole 18, a vertical insertion groove 19 communicating with the lateral groove 18, and an engaging notch 18*a* provided at the end of the lateral groove 18 opposite to the insertion groove 19. The lateral groove 18 has a pair of parallel walls 18*b* and 18*c*. A projection 20 is provided on the parallel wall 18*c* near the engaging notch 18*a*. Alternatively, a projection 20 may be provided on each of the parallel walls 18*b* and 18*c*. A wall-thickening portion 21 extends downwardly from the flange portion 6A on the outer face of the cylindrical section 6 to thicken the wall of the insertion groove 19.

Figure 3B:
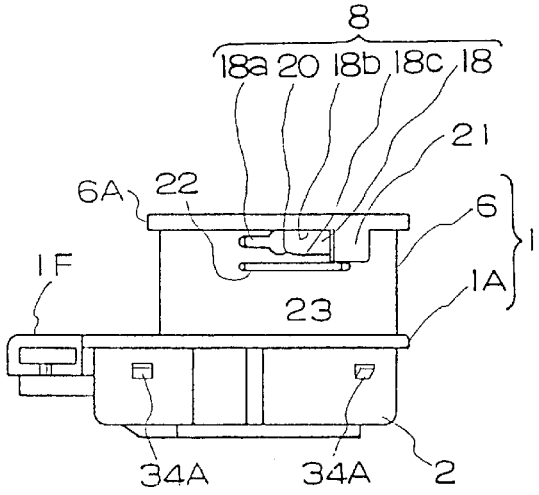
FIG. 3B is a side view of the lamp socket.
Figure 3C:
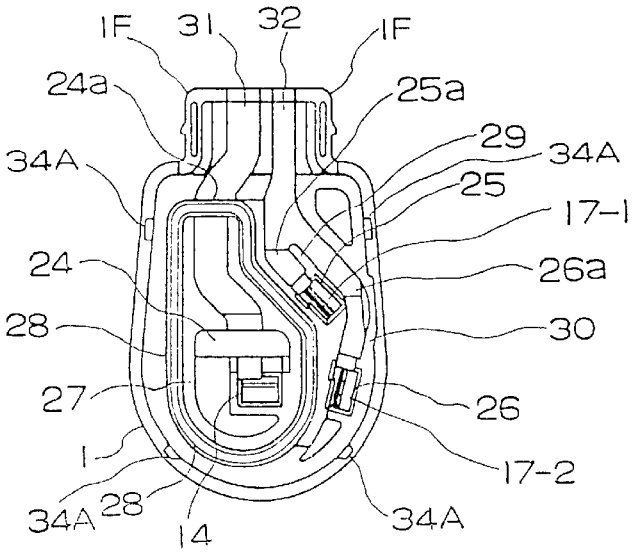
FIG. 3C is a bottom view of the lamp socket.
Figure 4:
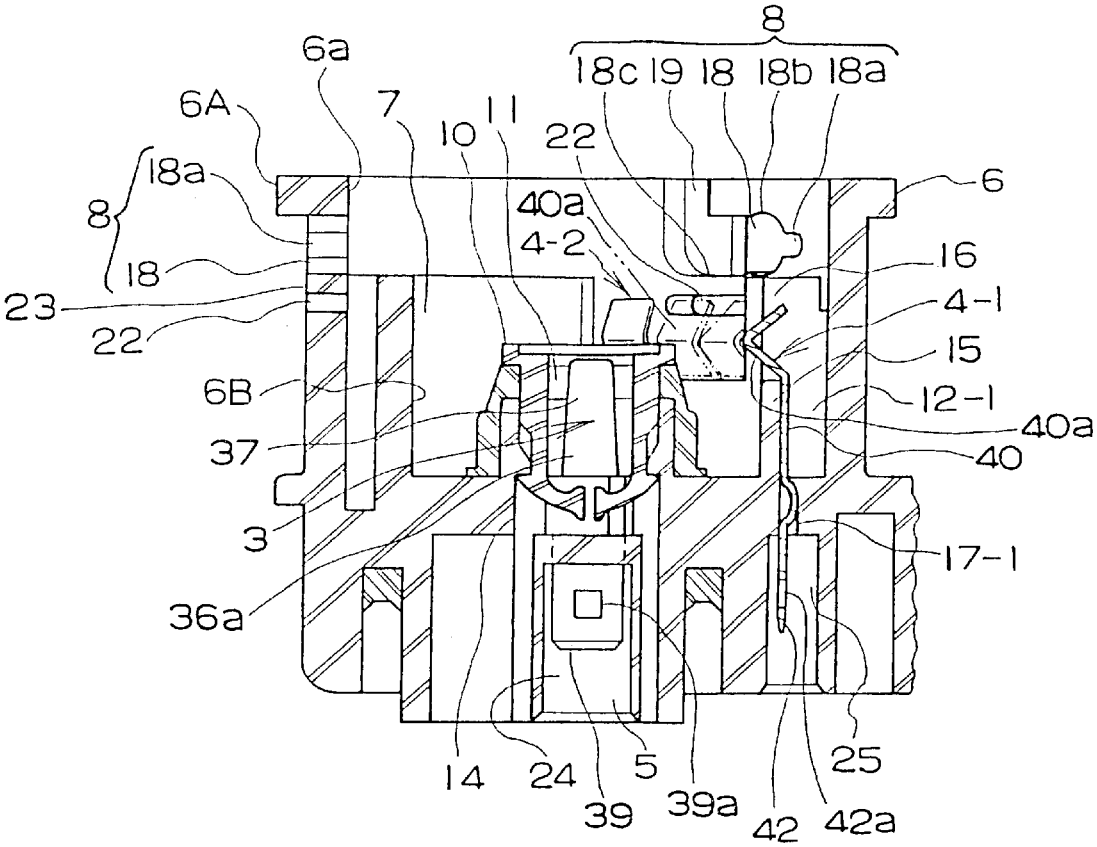
FIG. 4 is a sectional view taken along line G—G of FIG. 3A.

In FIGS. 2–4, a slit 22 is provided in the cylindrical section 6 in parallel to the engaging hole 18 on a side of the engaging hole 18 opposite to the flange portion 6A to form a flexible portion 23 between the engaging hole 18 and the slit 22.

In FIGS. 2–3, three terminal compartments 24, 25, and 26 are provided on the back side of the socket body 1. The first terminal compartment 24 is surrounded by a partition wall 27 except for an exit 24*a*. A seal groove 28 is provided outside the partition wall 27. The second terminal compartment 25 is surrounded by a partition wall 29 except for an exit 25*a* while the third terminal compartment 26 is surrounded by a partition wall 30 except for an exit 26*a*. The exit 24*a* communicates with a wire outlet 31 in a protruded section 1F while the exit 25*a* and 26*a* communicate with a wire outlet 32, respectively. A plurality of engaging projections 34A are provided on the side wall of the socket body 1.

A terminal aperture 14 is provided at the first terminal compartment 24 for receiving the terminal leg from the central terminal mount 11 while terminal apertures 17-1 and 17-2 are provided at the second and third terminal compartments 25 and 26, respectively, for receiving the terminal legs from the first and second peripheral terminal mounts 12-1 and 12-2, respectively. As best shown in FIG. 2, the cover 2 is provided with a plurality of engaging holes 34B and a wire outlet 35.

As shown in FIG. 4, the terminal 3 has a lamp contact 37 consisting of a pair of contact pieces 36*a* opposed at a C-shaped press-fit section (not shown) and a terminal leg 39 with an engaging hole 39*a* provided at an end opposite to the press-fit section.

As shown in FIGS. 1 and 4, the peripheral terminals 4-1 or 4-2 has three terminal sections which are joined by a linking section (not shown) and each have a contact point 40*a* at its tip, and a single terminal leg 42 which has an engaging hole 42*a*.

Figure 5B:
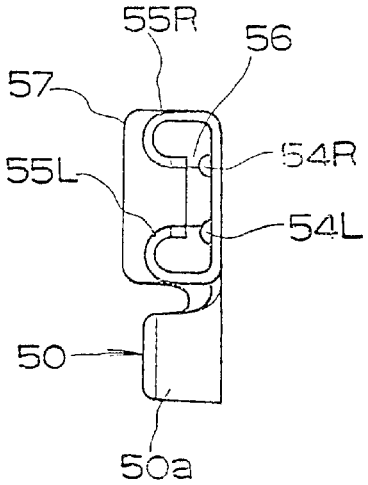
FIG. 5B is a front view of the crimp terminal as viewed from an arrow C of FIG. 5A.

As FIGS. 5A–B shows, the crimp terminal 5 has a wire retention section 50 having a pair of crimp tabs 50*a* and a terminal press-fit section 51 extending in a direction perpendicular to an axis [•] of the wire retention section 50. The terminal press-fit section 51 has a flat portion 52 with a lance 53. A pair of ridges 54L and 54R are provided on the flat portion 52 symmetrically with respect to an axis [□] of the flat portion 52. A pair of press tabs 55L and 55R are provided at opposite sides of the flat portion 52 and bent inwardly at their free end portions such that their free ends are positioned just above the ridges 54L and 54R, forming a pair of press-fit spaces 56. The end of the flat portion 52 is bent at right angles to form a stopper portion 57 for abutment with the mating terminal 42.

The terminal 3 is press-fitted in the central terminal mount 11 of the socket body 1 such that the terminal leg 39 passes through the terminal leg hole 14 into the first terminal compartment 24. The terminal 4-1 is press-fitted into the first peripheral terminal mount 12-1 of the socket body 1 such that the contact portion 40*a* of the terminal 4-1 is exposed to the plugging cavity 7 through the opening 16 while the terminal leg 42 projects into the second terminal compartment 25 through the aperture 17-1. The terminal 4-2 is press-fitted into the second peripheral terminal mount 12-2 of the socket body 1 such that the contact portion 40*a* of the terminal 4-2 is exposed to the socket cavity 7 through the opening 16 while the terminal leg 42 projects into the third terminal compartment 26 through the aperture 17-2.

The crimp terminal 5 is connected to the terminal leg 42 of each of the terminals 4-1 and 4-2 by inserting the terminal leg 42 into the press-fit spaces 56 of the crimp terminal 5 up to the stopper portion 57 so that the lance 53 engages the engaging hole 42*a* of the terminal leg 42. The crimp tabs 50*a* of the crimp terminal 5 are crimped to the core wire 58 of a conductor 59 for connection. Another crimp terminal (not shown), to which another conductor (not shown) has been connected, is connected to the terminal leg 39 of the terminal 3.

The detachable cover 2 is attached to the socket body 1 by engaging the engaging projections 34A with the engaging holes 34B so that the respective wire outlet ports 31, 32, and 35 are closed and the wire 59 and the wires connected to the crimp terminals are led to the outside through the wire outlet ports 31, 32, and 35.

Figure 6A:
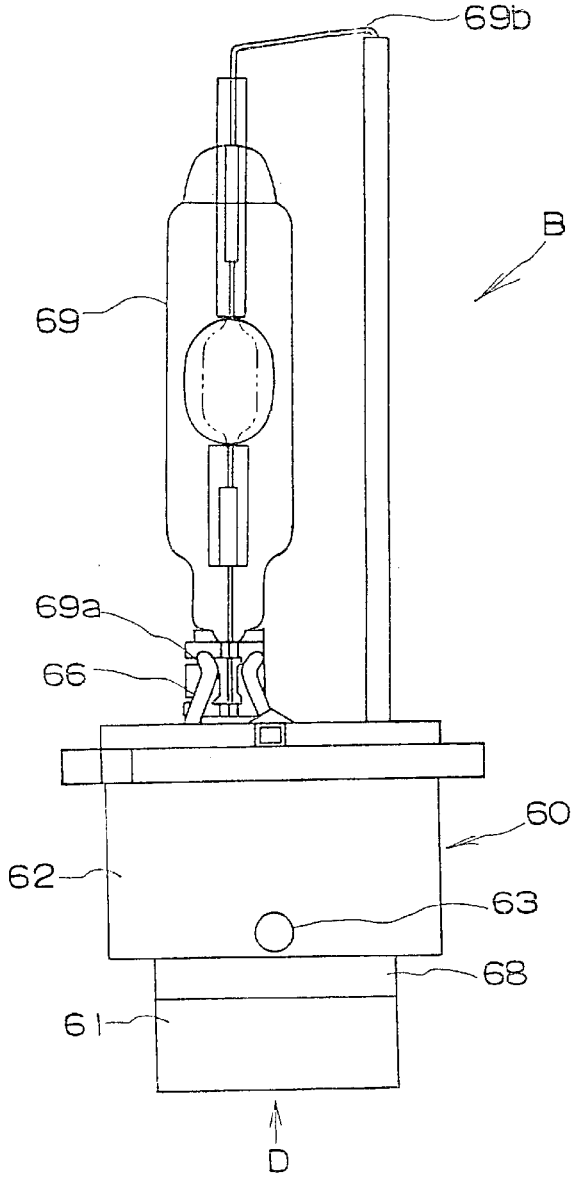
FIG. 6A is a side view of a lamp.
Figure 6B:
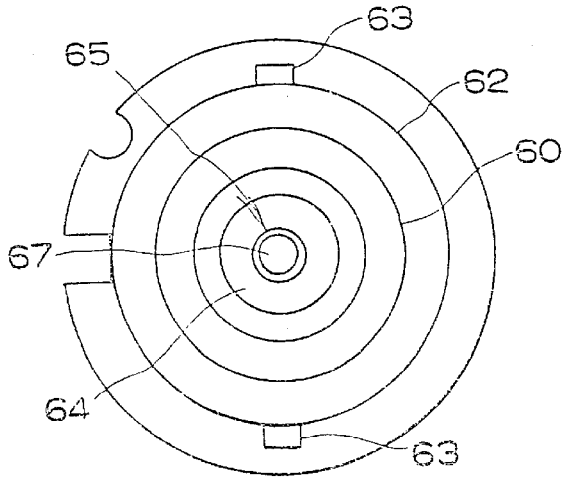
FIG. 6B is a bottom view from an arrow D of FIG. 6A.

As shown in FIG. 6, the lamp B comprises a lamp body 60 which has an engaging section 62 and a plug section 61 to be plugged into the socket cavity 7 of the lamp socket A. The engaging section 62 is provided with a an engaging pin 63 for engagement with the retention portion 8 of the lamp socket A. A circular recess 64 is provided in the end face of the plug section 61. The lamp terminal 65 is mounted at the central area of the lamp body 60 and provided with a lamp connection section 66 projecting from the top face of the lamp body 60. The contact section 67 of the lamp terminal 65 projects into the circular recess 64. An annular contact 68 is provided on the circumferential wall of the plug section 61.

A bulb 69 is connected to the connection section 66 of the lamp terminal 65 such that a contact point 69*a* of the bulb 69 is electrically connected to the lamp terminal 65 while the other point 69*b* is electrically connected to the annular contact section 68. The plug section 61 of the lamp B is plugged into the socket cavity 7 of the lamp socket A by inserting the engaging pins 63 into the insertion grooves 19 and rotating the lamp B to engage the engaging pin 63 with the engaging hole 18 so that the contact section 67 of the lamp terminal 65 is brought into contact with the contact section 37 of the terminal 3 while the annular contact 68 of the plug section 61 is brought into contact with the contact portions 40*a* of the terminals 4-1 and 4-2.

Consequently, the flexible portion 23 is flexed to expand the engaging hole 18, reducing the friction between the engaging pin 63 and the engaging hole 18 and facilitating attachment of the lamp B to the lamp socket A. Alternatively, the slit 22 may be provided between the engaging hole 18 and the flange portion 6A in parallel to the engaging hole 18 to produce similar effects or easy attachment of the lamp B to the lamp socket A.

When the lamp B is plugged out of the socket A, the flexible section 23 is flexed to facilitate movement of the engaging pin 63 and the removal operation. Since the flange portion 6A is provided at the circumference of the cylindrical section 6 and the thickening portion 21 extends from the flange portion 6A to thicken the bottom of the insertion groove 19, the strength of the end portion of cylindrical section 6 is maintained despite the presence of the insertion groove 19 and the engaging hole 18. As a result, if the lamp B is forcibly plugged in the lamp socket A in a wrong orientation, the cylindrical section 6 of the lamp socket A is not broken.

As has been described above, according to the invention, when the engaging pin of the lamp plug section is engaged with the engaging portion of a socket to plug the lamp plug section into the socket cavity so that the lamp terminal and the contact section are brought into contact with the first and second terminals, the flexible portion is flexed to expand the engaging portion and reducing the friction between them, facilitating movement of the engaging pin and thus attachment of the lamp to the lamp socket.

When the lamp is removed from the lamp socket, the flexible portion is flexed to facilitate movement of the engaging pin and the removal operation. Since the engaging hole is provided with a notch and expands in the plugging direction, insertion of the engaging pin into the engaging hole is secured.

When the engaging pin is inserted into the engaging hole to rotate the lamp or the reverse operation is performed, the engaging pin passes the ridge portion, producing a click and enhancing the operability. Since the flange portion is provided at the periphery of the cylindrical section and the thickening portion extends from the flange portion to thicken the bottom of the insertion groove, the end portion of cylindrical section is not impaired by forming the insertion groove and/or the engaging hole. As a result, when the lamp is forcibly plugged into the lamp socket in a wrong orientation, the cylindrical section of the lamp socket is not broken.

What is claimed is:

1. A lamp socket comprising:

a socket body having a cylindrical section with a plugging cavity into which a plugging section of a lamp is plugged, said cylindrical section having a flange portion at a successively continuous ring-shaped front edge hereof;

a first-type terminal provided at a central area of said plugging cavity for contact with a lamp terminal, a second-type terminal provided at a periphery of said plugging cavity for contact with a peripheral contact provided on said plugging section of said lamp; and a lamp retention section having an insertion groove provided on an inner peripheral surface of said cylindrical section and extending from an edge of said cylindrical section in an axial direction of said cylindrical section for receiving an engaging pin provided on a side wall of said plugging section of said lamp, an engaging hole extending from said insertion groove in a circumferential direction of said cylindrical section for engagement with said engaging pin, and a notch provided at an end of said engaging hole opposite to an end communicating with said insertion groove; and a slit provided in said cylindrical section in parallel to said engaging hole to form a flexible portion between said slit and said engaging hole for facilitating movement of said engaging pin along said engaging hole, wherein said cylindrical section has a thickening portion extending downwardly from outer surface of said flange portion to strengthen said cylindrical section.

2. A lamp socket according to claim 1, wherein said engaging hole has a pair of parallel walls, at least one of which has a projection thereon.

* * * * *